US009624796B2

(12) United States Patent
Kajiura et al.

(10) Patent No.: US 9,624,796 B2
(45) Date of Patent: Apr. 18, 2017

(54) VALVE-TIMING CONTROL APPARATUS FOR INTERNAL COMBUSTION ENGINE

(71) Applicant: HITACHI AUTOMOTIVE SYSTEMS, LTD., Hitachinaka-shi, Ibaraki (JP)

(72) Inventors: Mikihiro Kajiura, Tama (JP); Yosuke Iwase, Yokohama (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 14/883,718

(22) Filed: Oct. 15, 2015

(65) Prior Publication Data

US 2016/0108778 A1 Apr. 21, 2016

(30) Foreign Application Priority Data

Oct. 16, 2014 (JP) ..... 2014-211290

(51) Int. Cl.

| | |
|---|---|
| ***F01L 1/34*** | (2006.01) |
| ***F01L 9/04*** | (2006.01) |
| ***F01L 1/344*** | (2006.01) |
| ***F01L 1/047*** | (2006.01) |

(52) U.S. Cl.

CPC ..... *F01L 9/04* (2013.01); *F01L 1/047* (2013.01); *F01L 1/344* (2013.01); *F01L 2009/0401* (2013.01); *F01L 2009/0405* (2013.01)

(58) Field of Classification Search

CPC ... F01L 1/047; F01L 1/344; F01L 9/04; F01L 2009/0401; F01L 2009/0405

USPC ..... 123/90.11, 90.15, 90.17

See application file for complete search history.

(56) References Cited

U.S. PATENT DOCUMENTS 9,027,519 B2 * 5/2015 Tadokoro ..... F01L 1/344 123/90.15

FOREIGN PATENT DOCUMENTS

JP 2013-036401 A 2/2013

* cited by examiner

*Primary Examiner* — Ching Chang

(74) *Attorney, Agent, or Firm* — Foley & Lardner LLP

(57) ABSTRACT

A valve-timing control apparatus includes an electric motor; a speed-reduction mechanism configured to reduce a rotational speed of the output shaft of the electric motor; a slip ring provided on a surface of a tip portion of the electric motor; a cover member provided to cover at least a part of the surface of the tip portion of the electric motor; a power-feeding brush disposed in the cover member and being in contact with the slip ring; and an angle sensing mechanism configured to sense a rotational angle of the output shaft of the electric motor. The angle sensing mechanism includes a detected portion attached to the output shaft of the electric motor, and a detecting portion attached to the cover member and opposed to the detected portion. The power-feeding brush is located so as not to overlap with the detected portion in a vertically-upper direction from the detected portion.

15 Claims, 14 Drawing Sheets

VALVE-TIMING CONTROL APPARATUS FOR INTERNAL COMBUSTION ENGINE

BACKGROUND OF THE INVENTION

The present invention relates to a valve-timing control apparatus for an internal combustion engine, which serves for a valve-timing control based on rotational force of an electric actuator.

Japanese Patent Application Publication No. 2013-036401 discloses a previously-proposed valve-timing control apparatus.

In this technique, a power-feeding plate is arranged on a frontward end portion of an electric motor, and an outside of the power-feeding plate is covered by a cover member. A power-feeding brush which is slidably provided in a retaining hole of the cover member is in contact with a slip ring provided on an outside surface of the power-feeding plate, so that electric power is supplied to the electric motor.

SUMMARY OF THE INVENTION

A so-call electromagnetic-induction-type angle sensing means is provided axially between the cover member and an output shaft of the electric motor. This angle sensing means includes a detected portion (target portion) fixed to a tip of the output shaft of the electric motor, and a detecting portion attached to the cover member to be opposed to the detected portion through a predetermined axial clearance. A drive control of the electric motor is performed by detecting a rotational angle of the output shaft of the electric motor by way of the angle sensing means.

However, in the case of the previously-proposed valve-timing control apparatus, the power-feeding brush is substantially located at an upper end portion of the cover member with respect to a vertical direction. Hence, when abrasion power produced by a sliding contact between the power-feeding brush and the retaining hole falls by gravity, there is a risk that the abrasion power adheres to the angle sensing means so that a detection accuracy of the angle sensing means is reduced.

It is therefore an object of the present invention to provide a valve-timing control apparatus for an internal combustion engine, devised to attain a favorable detection accuracy of the angle sensing means by inhibiting abrasion powder of the power-feeding brush from adhering to the angle sensing means.

According to one aspect of the present invention, there is provided a valve-timing control apparatus for an internal combustion engine, wherein an operating characteristic of an engine valve is varied by varying a relative rotational position between a first member and a second member, the valve-timing control apparatus comprising: an electric motor configured to rotate the second member relative to the first member by rotating an output shaft of the electric motor; a speed-reduction mechanism configured to reduce a rotational speed of the output shaft of the electric motor and to transmit a reduced rotation of the output shaft to the second member such that the second member is rotated relative to the first member; a slip ring provided on a surface of a tip portion of the electric motor; a cover member provided to cover at least a part of the surface of the tip portion of the electric motor; a power-feeding brush disposed in the cover member such that the power-feeding brush is in contact with the slip ring; and an angle sensing mechanism configured to sense a rotational angle of the output shaft of the electric motor, wherein the angle sensing mechanism includes a detected portion attached to the output shaft of the electric motor, and a detecting portion attached to the cover member and opposed to the detected portion through a predetermined axial clearance, wherein the power-feeding brush is located so as not to overlap with the detected portion in a vertically-upper direction from the detected portion.

According to another aspect of the present invention, there is provided a valve-timing control apparatus for an internal combustion engine, comprising: a drive rotating member configured to rotate based on rotational force transmitted from a crankshaft; a driven rotating member integrally formed with a cam shaft; an electric motor integrally formed with the drive rotating member and configured to control a rotational phase of the driven rotating member relative to the drive rotating member by rotating an output shaft of the electric motor; a slip ring provided on an axially end surface of the electric motor; a cover member opposed to the slip ring; a power-feeding brush provided slidably in a retaining hole formed in the cover member, the power-feeding brush being configured to supply electric power to the electric motor by a contact with the slip ring; and an angle sensing mechanism configured to sense a rotational angle of the output shaft of the electric motor through a detecting portion attached to the cover member, wherein the power-feeding brush is located at a portion of the cover member which prevents abrasion power of the power-feeding brush from adhering to the detecting portion even if the abrasion power falls by gravity.

The other objects and features of this invention will become understood from the following description with reference to the accompanying drawings.

DETAILED DESCRIPTION OF THE INVENTION

Figure 1:
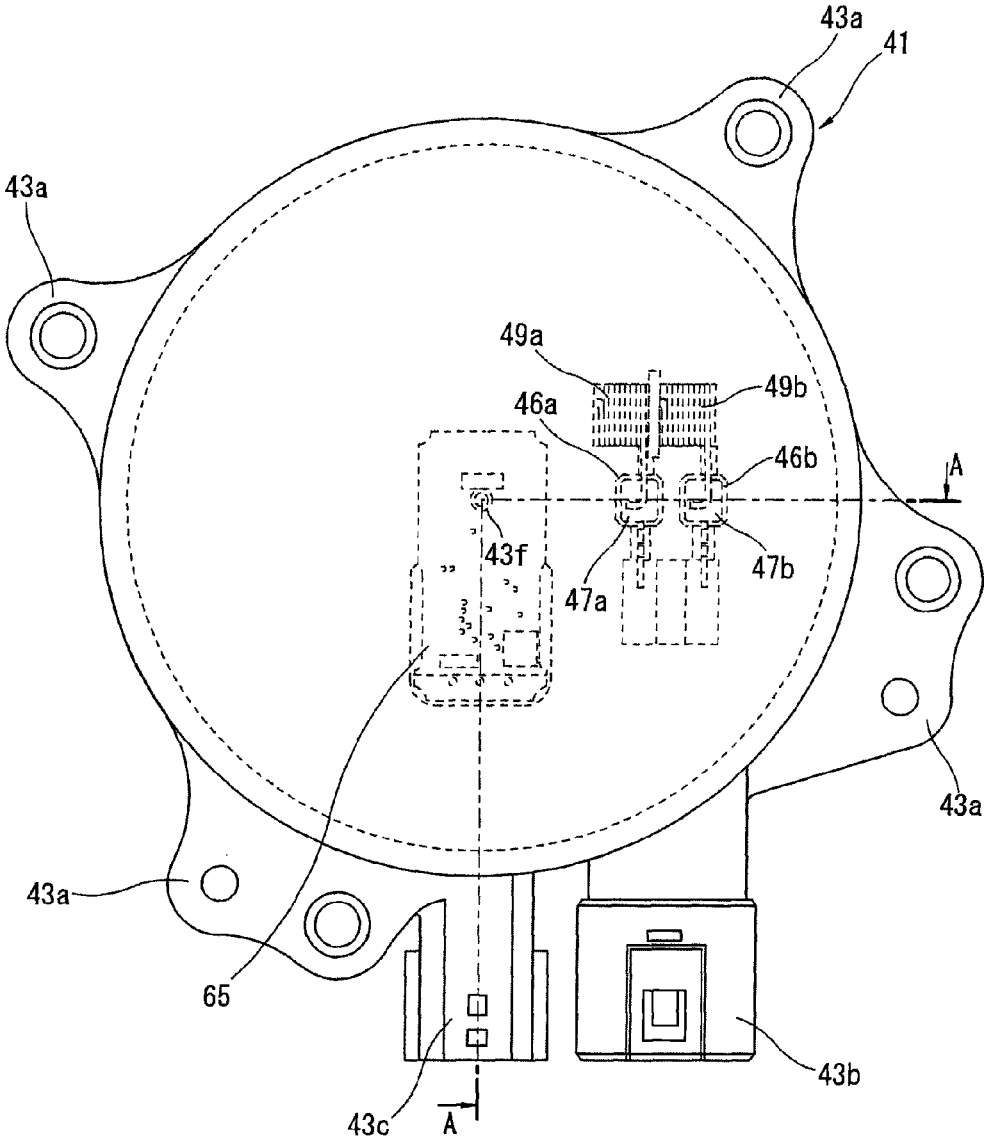
FIG. 1 is a front view of a valve-timing control apparatus in a first embodiment according to the present invention.

Reference will hereinafter be made to the drawings in order to facilitate a better understanding of the present invention. Hereinafter, embodiments of valve-timing control apparatus for an internal combustion engine according to the present invention will be explained referring to the drawings. In the following embodiments, the valve-timing control apparatus according to the present invention is applied to an intake side of the internal combustion engine.

First Embodiment

Figure 2:
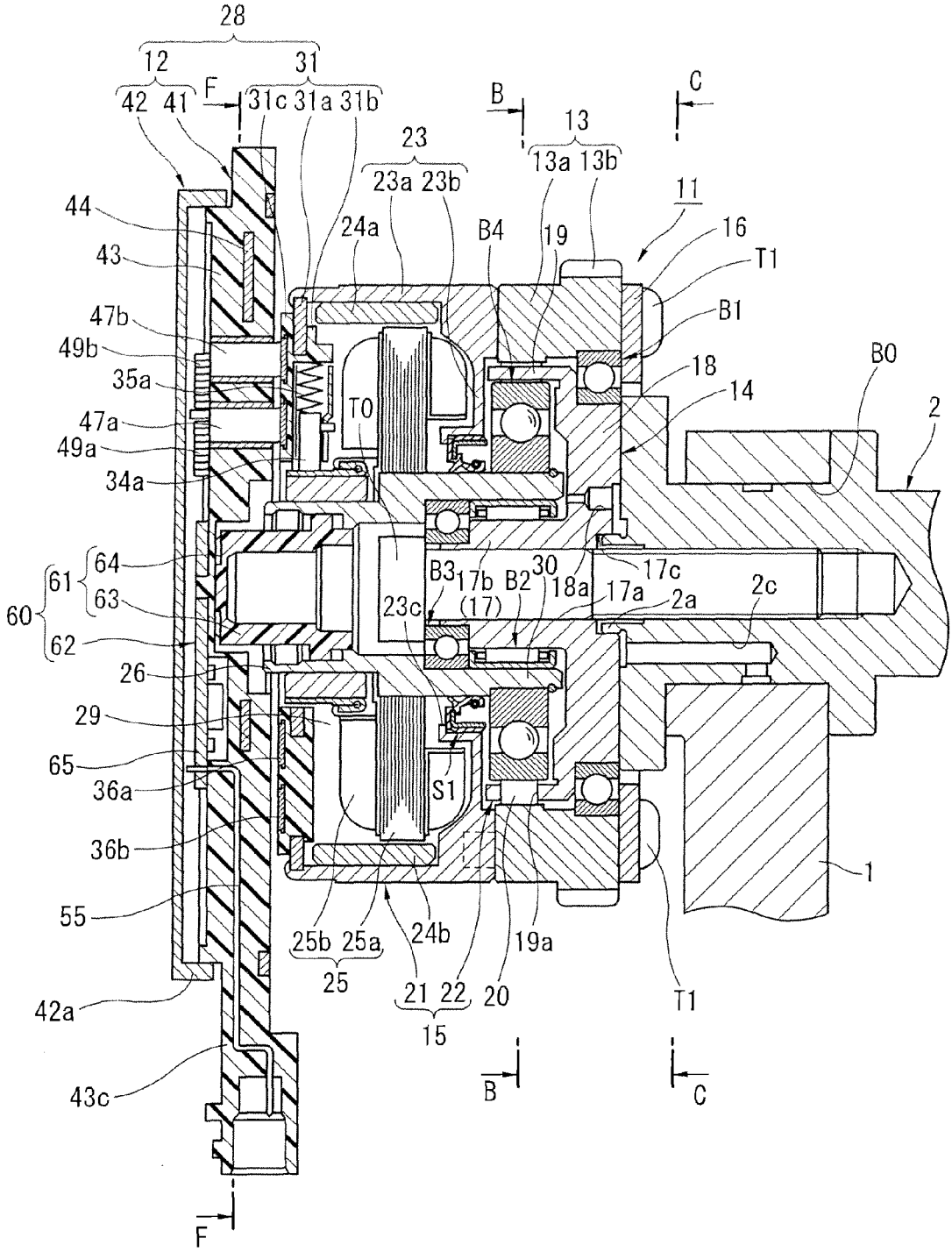
FIG. 2 is a sectional view of FIG. 1, taken along a line A-A.
Figure 3:
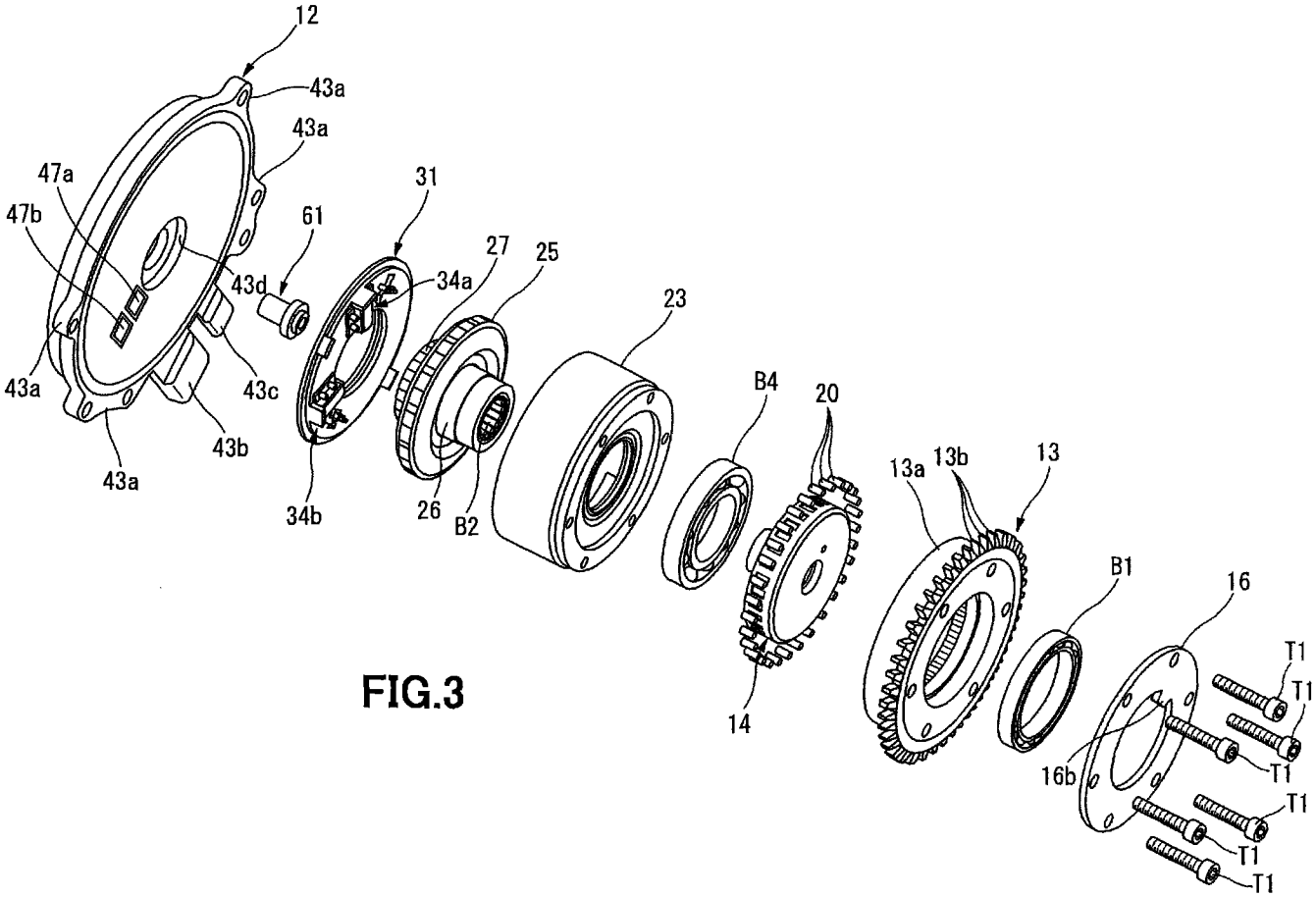
FIG. 3 is an exploded oblique perspective view showing structural elements of the valve-timing control apparatus of FIG. 2.
Figure 4:
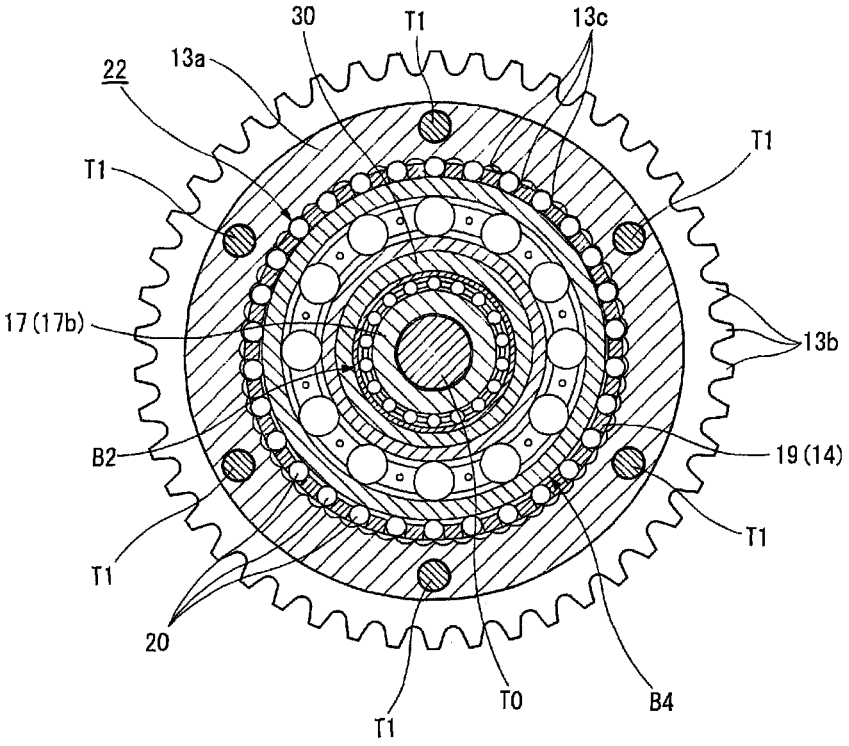
FIG. 4 is a sectional view of FIG. 2, taken along a line B-B.

FIGS. 1 to 12 show a first embodiment of the valve-timing control apparatus according to the present invention. As shown in FIGS. 1 to 3, the valve-timing control apparatus 11 includes a timing sprocket 13, a follower member 14, a phase change mechanism 15 and a cover member 12. The timing sprocket 13 is a first member (functioning as a drive rotating member) which receives rotary drive force transmitted from a crankshaft (not shown) of an internal combustion engine and thereby rotates in synchronization with the crankshaft. The follower member 14 is a second member (functioning as a driven rotating member) which is fixed to one end portion of a cam shaft 2 and rotates integrally with the cam shaft 2. The cam shaft 2 is rotatably supported by a cylinder head 1 through a bearing B0. The phase change mechanism 15 is interposed between the timing sprocket 13 and the follower member 14, and changes a relative rotational phase between the timing sprocket 13 and the follower member 14 in accordance with an operating state of the engine. The cover member 12 is provided to cover a front end side of the phase change mechanism 15.

The timing sprocket 13 includes a tubular base portion 13*a* and a gear portion (teeth portion) 13*b*. The tubular base portion 13*a* constitutes a sprocket main body whose inner circumferential surface is formed in a stepped shape to have two relatively large and small diameters as shown in FIG. 2. The gear portion 13*b* is integrally formed with an outer circumference of another end portion (cam-shaft-side portion) of the tubular base portion 13*a*. The gear portion 13*b* receives rotary drive force transmitted through a wound timing chain (not shown) from the crankshaft. Whole of the timing sprocket 13 including the tubular base portion 13*a* and the gear portion 13*b* is integrally formed of an iron-based metal. The timing sprocket 13 is rotatably supported through a first bearing B1 by the follower member 14 disposed radially inward of the tubular base portion 13*a*. The first bearing B1 is a known ball bearing. An opening of one end (front-side end) of the tubular base portion 13*a* is closed by an after-mentioned electric motor 21 whereas an opening of another end (rear-side end) of the tubular base portion 13*a* is partially closed by a stopper plate 16. The timing sprocket 13 is fastened to the electric motor 21 by a plurality of first bolts T1. The stopper plate 16 is substantially in the form of circular plate, and is fixed to the timing sprocket 13 by the plurality of first bolts T1 together.

The follower member 14 includes a tubular base portion 17, a circular plate portion 18 and a roller retaining portion 19 which are integrally formed. The tubular base portion 17 is located at a radially center portion of the follower member 14. The circular plate portion 18 extends from an axially intermediate portion of the tubular base portion 17 in a radially outer direction. The roller retaining portion 19 extends from a radially outer portion of the circular plate portion 18 in an axial direction toward the electric motor 21. That is, the roller retaining portion 19 extends from an axially one end portion (an end portion closer to the electric motor 21) of the circular plate portion 18 such that a diameter of the roller retaining portion 19 is larger than that of the circular plate portion 18. The roller retaining portion 19 retains or guides a plurality of rollers (rolling elements) 20 in a circumferential direction. An end portion of the tubular base portion 17 of the follower member 14 which is closer to the cam shaft 2 (i.e. an after-mentioned another end portion 17*c*) is fitted over a convex portion 2*a* of the cam shaft 2. This convex portion 2*a* is formed to protrude from the cam shaft 2 in the axial direction. Accordingly, the follower member 14 is fixed to the cam shaft 2 by a cam bolt T0 in the state where a concentric (coaxial) arrangement between the follower member 14 and the cam shaft 2 is secured.

The tubular base portion 17 is formed with an insertion hole 17*a* which passes through a center portion of the tubular base portion 17 in the axial direction. An outer circumferential surface of one end portion 17*b* (an end portion closer to the electric motor 21) of the tubular base portion 17 is fitted and attached into a second bearing B2 which is a known needle bearing. The another end portion 17*c* (the end portion closer to the cam shaft 2) of the tubular base portion 17 is formed with an axially-depressed concave portion which is fitted over the convex portion 2*a* of the cam shaft 2. Moreover, a third bearing B3 which is a known ball bearing is provided axially adjacent to one end side (one end portion 17*b*) of the tubular base portion 17. The third bearing B3 rotatably supports an after-mentioned output shaft member 26. An inner race of the third bearing B3 is supported by being sandwiched between one end of the tubular base portion 17 and a head portion of the cam bolt T0.

The circular plate portion 18 is formed with an oil hole 18*a* located at a circumferentially predetermined portion of the circular plate portion 18. The oil hole 18*a* passes through the circular plate portion 18 in the axial direction, and serves to supply lubricant from the cam shaft 2 to the second and third bearings B2 and B3 and the like. Moreover, an outer circumferential surface of the circular plate portion 18 is fitted and attached into the first bearing B1. By this first bearing B1, the timing sprocket 13 is rotatably supported.

The roller retaining portion 19 is formed in a substantially tubular shape. The roller retaining portion 19 is formed with a plurality of roller-retaining holes 19*a* at circumferentially predetermined intervals. The plurality of roller-retaining holes 19*a* radially pass through the roller retaining portion 19, and respectively retain the plurality of rollers 20. That is, each of the plurality of roller-retaining holes 19*a* accommodates the roller 20 and thereby rotatably retains the roller 20.

Figure 5:
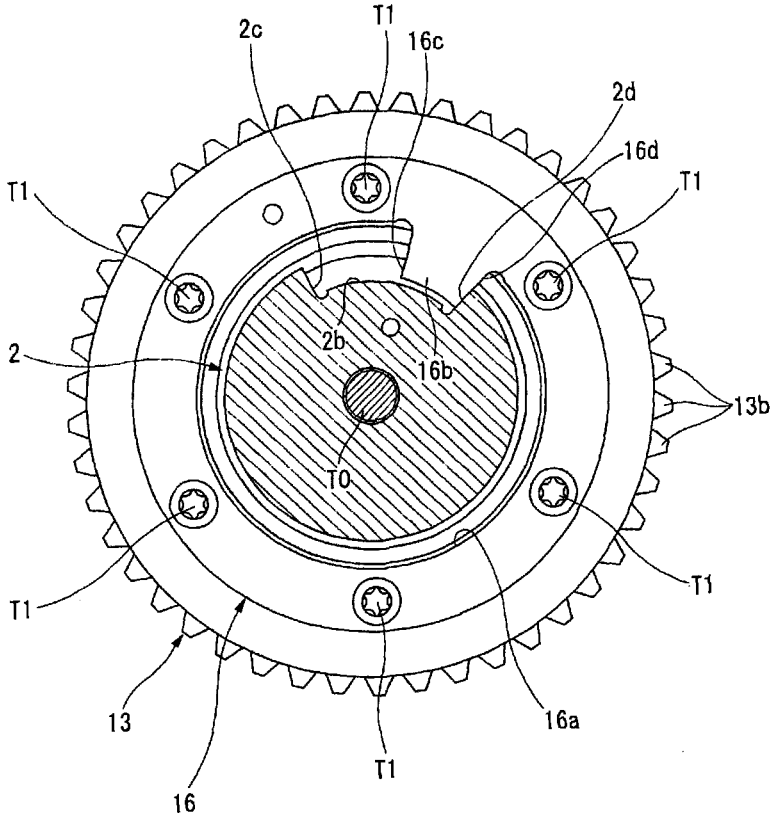
FIG. 5 is a sectional view of FIG. 2, taken along a line C-C.

As shown in FIGS. 2 and 5, the stopper plate 16 is formed with an insertion hole (shaft-receiving hole) 16*a* which passes through a center portion of the stopper plate 16 in the axial direction. The one end portion of the cam shaft 2 is inserted into the insertion hole 16*a*. The stopper plate 16 includes a restriction convex portion 16*b* which protrudes in a radially-inner direction of the stopper plate 16 over a circumferentially predetermined range of the insertion hole 16*a*. The restriction convex portion 16*b* is located within (is engaged with) a restriction concave portion 2*b* of the cam shaft 2. The restriction concave portion 2*b* is formed by cutting an outer circumferential surface of the one end portion of the cam shaft 2 as an arc-shaped depression. By such a structure, circumferentially-both side ends 16*c* and 16*d* of the restriction convex portion 16*b* respectively become in contact with circumferentially-both side ends 2*c* and 2*d* of the restriction concave portion 2*b* which are opposed to the circumferentially-both side ends 16*c* and 16*d*, so that a relative movement between the cam shaft 2 and the stopper plate 16 is restricted. In other words, a relative rotation between the follower member 14 and the stopper plate 16, i.e., a relative rotation between the timing sprocket 13 and the cam shaft 2 is permitted only in a range determined by a circumferential width of the restriction concave portion 2*b*.

As shown in FIG. 2, the phase change mechanism 15 mainly includes the electric motor 21 and a speed-reduction mechanism 22. The electric motor 21 is arranged coaxially to the cam shaft 2 through the follower member 14. The electric motor 21 is an electric actuator which is drivingly rotated by a control current derived from an electronic control unit (not shown). The electric motor 21 produces torque for the phase change. The speed-reduction mechanism 22 is interposed between the electric motor 21 and the follower member 14. The speed-reduction mechanism 22 functions to reduce an output speed of the electric motor 21 and to transmit the reduced output speed to the cam shaft 2. The electronic control unit drivingly controls the electric motor 21 on the basis of engine operating state derived from various kinds of sensors and the like, such as a crank angle sensor, an air flow meter, a water temperature sensor and a throttle sensor (not shown).

The electric motor 21 is a brush DC motor which has after-mentioned first and second brushes 34*a* and 34*b*. The electric motor 21 mainly includes a yoke 23, a pair of permanent magnets 24*a* and 24*b*, an armature 25, the output shaft member 26, a commutator 27, and a power-feeding mechanism 28. The yoke 23 is in the form of cylinder having its bottom. The yoke 23 is fixed to the timing sprocket 13 by the respective first bolts T1, and rotates integrally with the timing sprocket 13. The pair of permanent magnets 24*a* and 24*b* function as a stator. Each of the pair of permanent magnets 24*a* and 24*b* is in the form of halved-cylinder, and is fixed to an inner circumferential surface of the yoke 23. The armature 25 is provided radially inward of the permanent magnets 24*a* and 24*b* to be rotatable relative to the permanent magnets 24*a* and 24*b*, and functions as a rotor. The output shaft member 26 is inserted and fixed into an inner circumferential portion of the armature 25, and thereby rotates integrally with the armature 25. The output shaft member 26 functions as an output shaft of the armature 25. The commutator 27 is provided on an outer circumferential surface of one end portion of the output shaft member 26 which axially extends in a direction toward an opening of the yoke 23. The power-feeding mechanism 28 is provided to cover or close the opening of one end portion of the yoke 23. The power-feeding mechanism 28 supplies electric power through the commutator 27 to (after-mentioned coils 25*b* of) the armature 25.

The yoke 23 includes a cylindrical portion 23*a* and a bottom wall portion 23*b*. The cylindrical portion 23*a* has an outer diameter substantially equal to an outer diameter of the tubular base portion 13*a* of the timing sprocket 13. The bottom wall portion 23*b* is formed at an end portion of the cylindrical portion 23*a* which is opposed to the timing sprocket 13. The yoke 23 is arranged axially in series with the timing sprocket 13 such that an outside surface (rearward surface) of the bottom wall portion 23*b* covers or closes an opening of one end portion (frontward portion) of the timing sprocket 13. The yoke 23 is integrally fastened to the timing sprocket 13 and the stopper plate 16 by the plurality of first bolts T1 which pass through the timing sprocket 13. An opening of one end portion of the cylindrical portion 23*a* is closed by (an after-mentioned power-feeding plate 31 of) the power-feeding mechanism 28.

The bottom wall portion 23*b* is formed with a shaft insertion hole 23*c* which passes through a substantially center portion of the bottom wall portion 23*b*. The output shaft member 26 is inserted through the shaft insertion hole 23*c* so that another end portion (rearward portion) of the output shaft member 26 is located near the follower member 14. The another end portion of the output shaft member 26 is connected with the speed-reduction mechanism 22. A first seal member S1 is provided at a hole edge of the shaft insertion hole 23*c* which is closer to the speed-reduction mechanism 22. The first seal member S1 located between the yoke 23 and the output shaft member 26 liquid-tightly seals a motor accommodating space 29 formed radially inward of the yoke 23. Accordingly, the first seal member S1 inhibits lubricating oil from flowing from the speed-reduction mechanism 22 to the motor accommodating space 29.

The armature 25 includes a rotor 25*a* and the plurality of coils 25*b*. The rotor 25*a* is an iron core provided on an outer circumferential surface of an axially central portion of the output shaft member 26. The plurality of coils 25*b* are wound on the rotor 25*a*. The plurality of coils 25*b* are electrically connected through the commutator 27 to the power-feeding plate 31 so as to enable an energization.

An inner part of an axially end portion (the another end portion) of the output shaft member 26 which is opposed to the follower member 14 is supported through the third bearing B3 by the cam bolt T0. On the other hand, an outer part of the axially end portion (the another end portion) of the output shaft member 26 is supported through the second bearing B2 by the follower member 14. Moreover, the another end portion of the output shaft member 26 includes an eccentric shaft portion 30 which constitutes a part of the speed-reduction mechanism 22. The eccentric shaft portion 30 is formed integrally with the output shaft member 26. An outer circumferential surface of the eccentric shaft portion 30 has an axis (center line) different (eccentric) from an axis of the other axial region of the output shaft member 26.

The power-feeding mechanism 28 includes the power-feeding plate 31 and the cover member 12. The power-feeding plate 31 closes the opening of the one end portion of the yoke 23. The power-feeding plate 31 supplies electric power through the commutator 27 to (the coils 25*b* of) the armature 25. The cover member 12 is arranged to be in contact with (connected with) the power-feeding plate 31 such that the cover member 12 covers an outside surface of the power-feeding plate 31. The cover member 12 applies the control current derived from the electronic control unit, through the power-feeding plate 31 to the electric motor 21. Hence, the electric motor 21 is controllably driven.

The power-feeding plate 31 includes a core member 31*a*, an inside insulating portion 31*b* and an outside insulating portion 31*c*. The core member 31*a* is made of iron-based metallic material, and is substantially in the form of circular plate. The inside insulating portion 31*b* and the outside insulating portion 31*c* are made of resin. The inside insulating portion 31*b* and the outside insulating portion 31*c* are integrally provided on inside and outside surfaces of the core member 31*a* by a mold forming. The power-feeding plate 31 is fixed to an end portion of the opening (of the one end portion) of the yoke 23, through the core member 31*a* by caulking.

Figure 6:
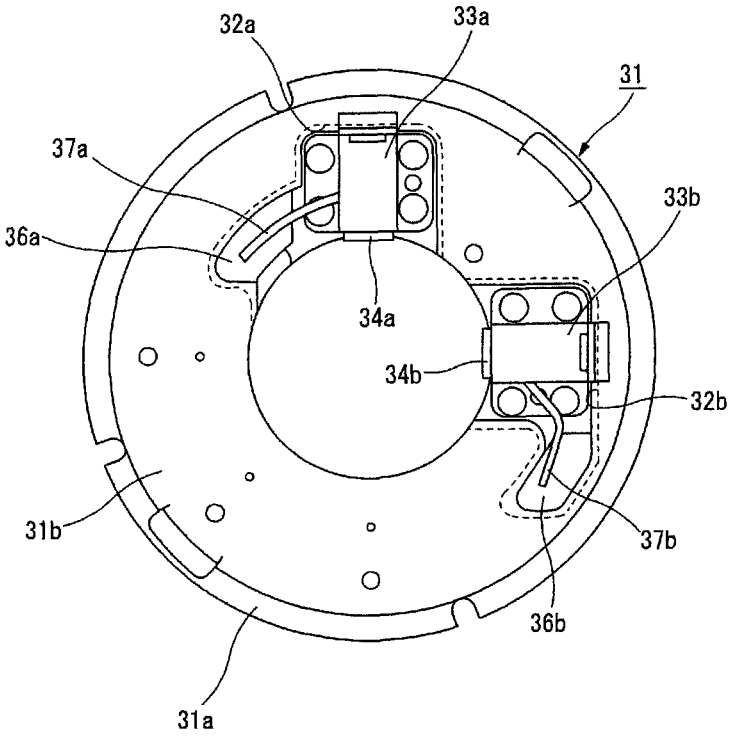
FIG. 6 is a rear view of a power-feeding plate shown in FIG. 3.

As shown in FIGS. 2 and 6, the core member 31*a* includes two retaining holes 32*a* and 32*b* each of which is formed by cutting a circumferentially predetermined portion of the core member 31*a* in an odd shape. A pair of metallic brush holders 33*a* and 33*b* are attached and fixed to the inside insulating portion 31*b* of the power-feeding plate 31 at locations of the two retaining holes 32*a* and 32*b*. Each of the brush holders 33*a* and 33*b* accommodates and receives a switching brush 34*a*, 34*b* and a spring 35*a*, 35*b*. The switching brush 34*a*, 34*b* is provided to be slidably in contact with an outer circumferential surface of the commutator 27. The spring 35*a*, 35*b* biases the switching brush 34*a*, 34*b* toward the commutator 27.

Moreover, a pair of slip rings 36*a* and 36*b* are provided on the outside insulating portion 31*c* at radially inner and outer portions of the outside insulating portion 31*c*. That is, the pair of slip rings 36*a* and 36*b* have small and large diameters, and are disposed to overlap with each other in the radial direction. The pair of slip rings 36*a* and 36*b* are axially opposed to power-feeding brushes 47*a* and 47*b* installed in the cover member 12. The pair of slip rings 36*a* and 36*b* are connected to the switching brushes 34*a* and 34*b* through harnesses 37*a* and 37*b* which pass through the retaining holes 32*a* and 32*b*.

As shown in FIGS. 1 and 2, the cover member 12 includes a cover main body 41 and a cover portion 42. The cover main body 41 is substantially in the form of a circular plate, and has an outer diameter larger than an outer diameter of (the yoke 23 of) the electric motor 21. The cover main body 41 is disposed to be opposed to the power-feeding plate 31 such that the cover main body 41 covers the outside surface (the outside insulating portion 31*c*) of the power-feeding plate 31. The cover portion 42 is fitted over a radially outer portion of the cover main body 41 and thereby attached to the cover main body 41. The cover portion 42 covers a front end portion of the cover main body 41. The cover member 12 is fastened to a chain case (not shown) by bolts through a plurality of flange portions 43*a* formed in an outer peripheral portion (radially outer portion) of the cover main body 41.

Figure 8:
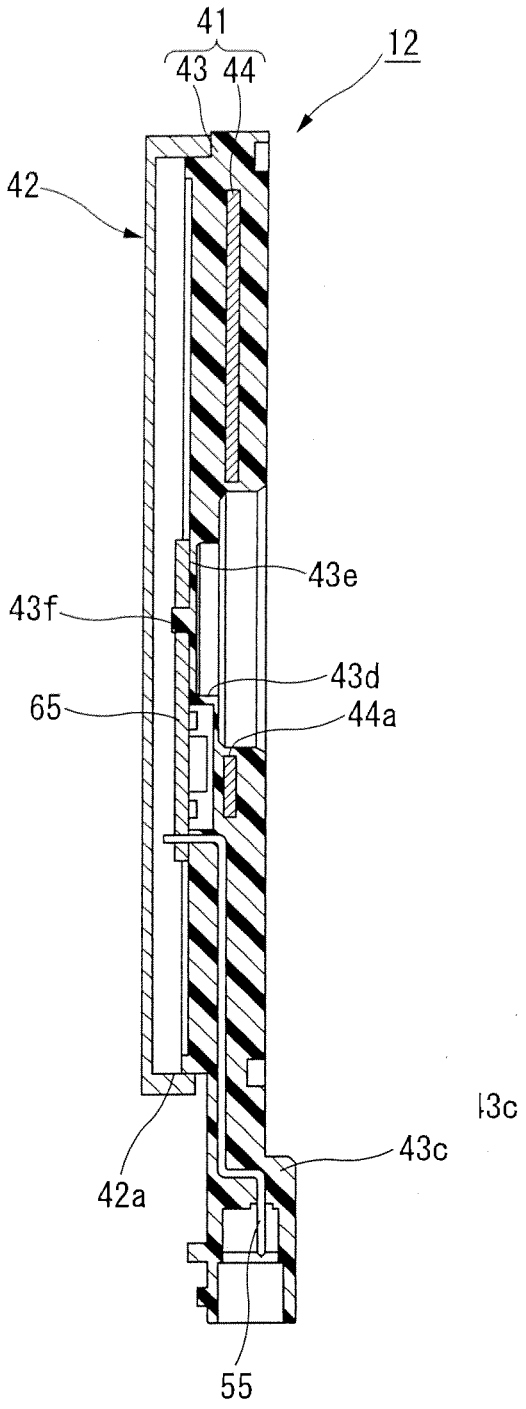
FIG. 8 is a sectional view of FIG. 7, taken along a line D-D.
Figure 9:
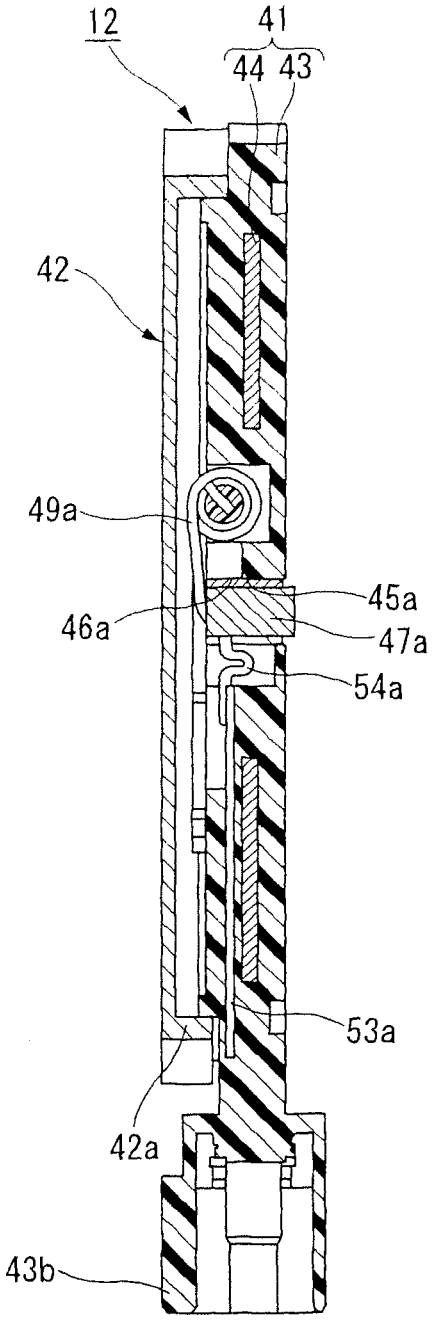
FIG. 9 is a sectional view of FIG. 7, taken along a line E-E.

As shown in FIGS. 8 and 9, the cover main body 41 includes a resin portion 43 and a core member 44. The resin portion 43 is made of a synthetic resin material. The core member 44 is made of a metallic material which has a linear expansion coefficient smaller than that of the synthetic resin material of the resin portion 43. The core member 44 is located inside the resin portion 43. The cover main body 41 is integrally formed by a mold forming of core member 44 and the resin portion 43.

Figure 10:
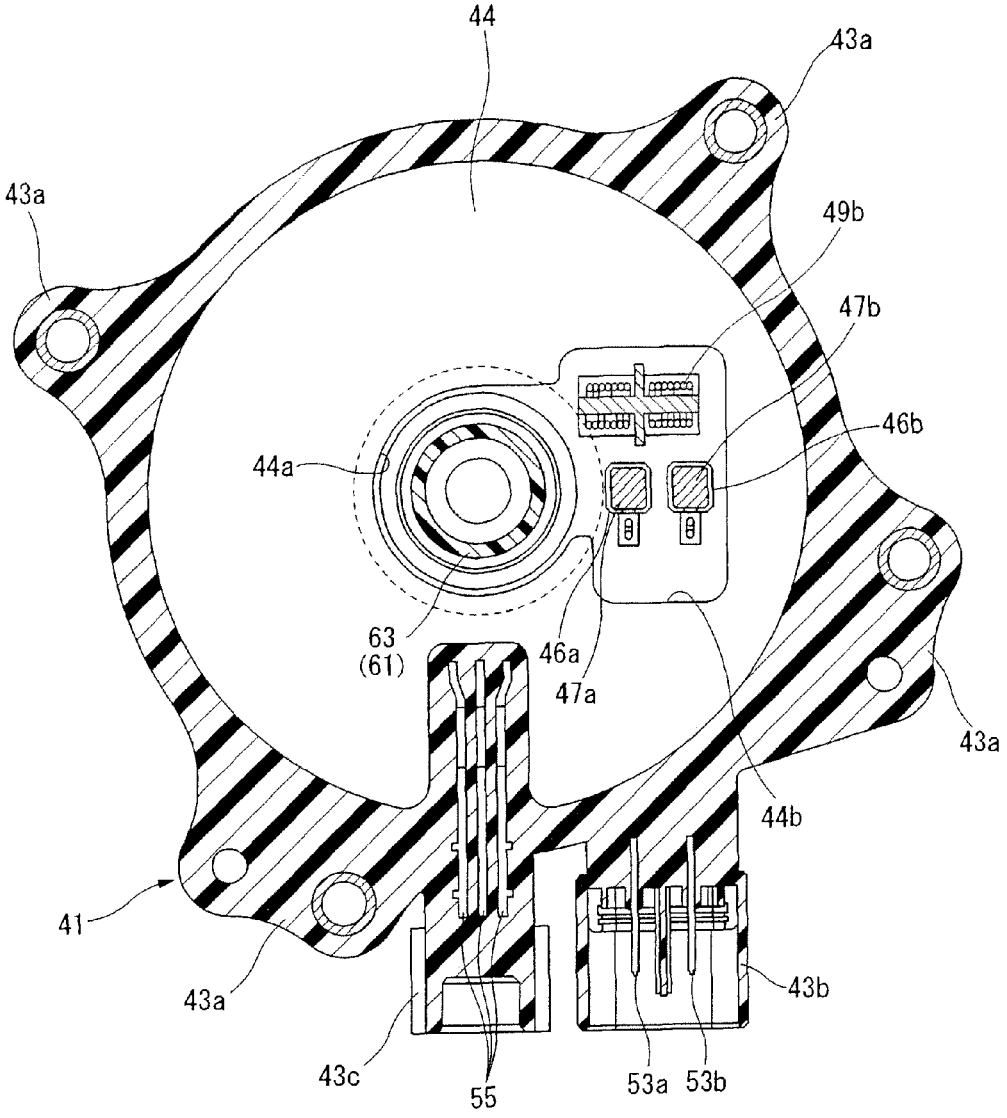
FIG. 10 is a sectional view of FIG. 2, taken along a line F-F.

As shown in FIGS. 8 and 10, the core member 44 is substantially shaped like a circular plate. The core member 44 is formed with an insertion hole 44*a* which passes through a substantially center portion of the core member 44. The insertion hole 44*a* is substantially in the form of circle as viewed in the axial direction. An after-mentioned angular sensor 60 (a tubular base portion 63) is inserted into the insertion hole 44*a*. Moreover, the core member 44 is formed with a window portion 44*b* which is substantially in the form of rectangle as viewed in the axial direction. The window portion 44*b* is formed by cutting a portion of the core member 44 which is near (continuous with) the insertion hole 44*a*. The power-feeding brushes 47*a* and 47*b* are inserted through the window portion 44*b*.

Figure 7:
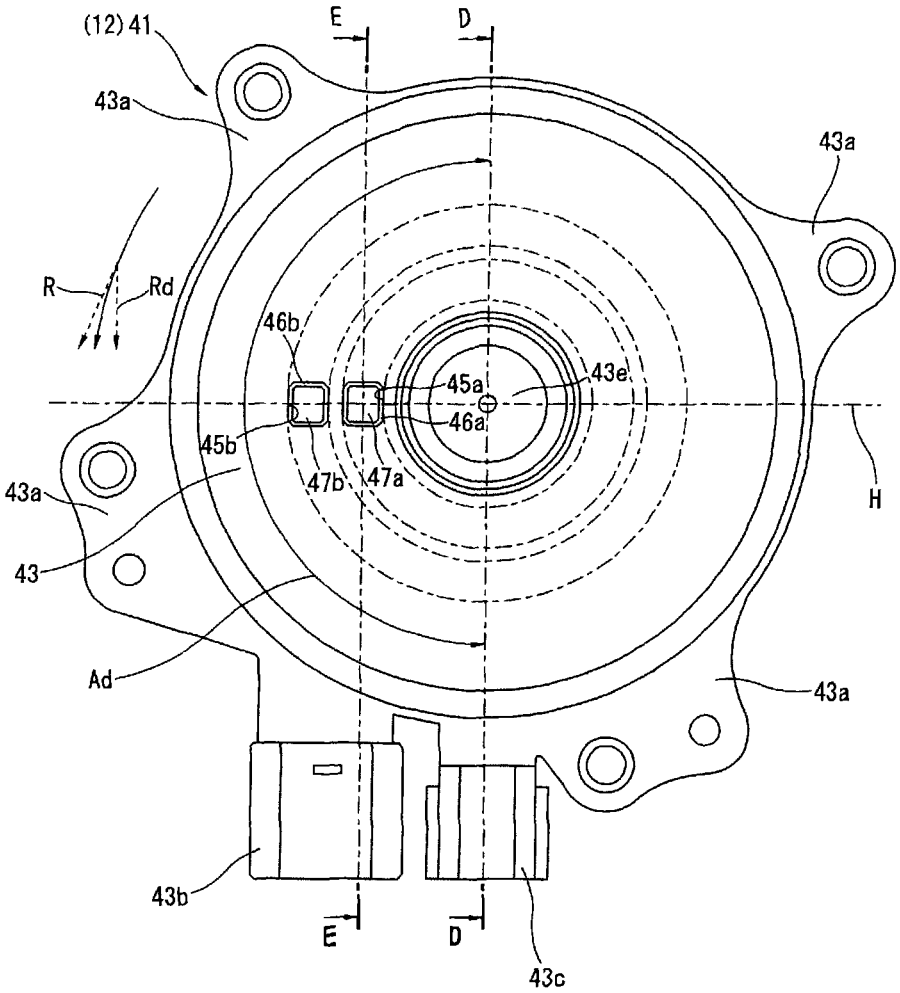
FIG. 7 is a rear view of a cover member shown in FIG. 3.

As shown in FIG. 7, the power-feeding brushes 47*a* and 47*b* (after-mentioned brush holders 46*a* and 46*b* or brush retaining holes 45*a* and 45*b*) which pass through the window portion 44*b* are arranged in series with each other on an imaginary horizontal line H which extends through a center of the insertion hole 44*a* in a radial direction of the cover main body 41. That is, as viewed in the axial direction, two sides of a rectangular shape of each of the power-feeding brushes 47*a* and 47*b* are perpendicular to a radial line of the cover main body 41 which passes through centers of the power-feeding brushes 47*a* and 47*b*. The power-feeding brushes 47*a* and 47*b* overlap with each other in the radial direction of the cover main body 41. In such a state, the power-feeding brushes 47*a* and 47*b* are opposed to and in contact with the slip rings 36*a* and 36*b*. In details, the power-feeding brushes 47*a* and 47*b* (also, the brush holders 46*a* and 46*b*, the brush retaining holes 45*a* and 45*b*) are positioned under the following conditions. At first, the power-feeding brushes 47*a* and 47*b* (also, the window portion 44*b*) do not overlap with an after-mentioned target 64 which constitutes a detected portion 61 of the angular sensor 60, in a vertically-upper direction (i.e. in a direction opposite to a gravitational-force direction) as viewed from the target 64. Next, the power-feeding brushes 47*a* and 47*b* (also, the window portion 44*b*) are located in a circumferential range Ad (see FIG. 7) of the cover main body 41 over which a rotational direction R of the timing sprocket 13 has a vertically-lower component Rd. Moreover, the power-feeding brushes 47*a* and 47*b* (also, the window portion 44*b*) overlap with the target 64 of the angular sensor 60 in the horizontal direction perpendicular to an extending direction of an after-mentioned power-feeding connector 43*b* or a communication connector 43*c*. That is, an imaginary straight line connecting a center of the target 64 with a center of each power-feeding brush 47*a*, 47*b* is perpendicular to the vertical direction, as viewed in the axial direction. Accordingly, even if abrasion powder of the power-feeding brushes 47*a* and 47*b* falls by gravity, the abrasion power is prevented from adhering to the target 64 of the angular sensor 60.

As shown in FIGS. 7 to 10, the resin portion 43 is substantially in the form of a circular disc. The resin portion 43 includes the four flange portions 43*a* which radially protrude at an outer circumferential portion of the resin portion 43. The resin portion 43 further includes the power-feeding connector 43*b* and the communication connector 43*c* which are located substantially at a lower end portion of the resin portion 43 between two of the four flange portions 43*a*. Each of the power-feeding connector 43*b* and the communication connector 43*c* is substantially in the form of rectangular tube and protrudes in the vertically lower direction (gravity direction). The resin portion 43 is formed with the pair of brush retaining holes 45*a* and 45*b* which axially pass through resin portion 43 and are opposed to the power-feeding plate 31. The pair of metallic brush holders 46*a* and 46*b* which are retaining-hole constituting members are inserted and held in the pair of brush retaining holes 45*a* and 45*b*. The power-feeding brushes 47*a* and 47*b* extend through the pair of brush retaining holes 45*a* and 45*b* to an external of the cover member 12, and slide perpendicularly in contact with the slip rings 36*a* and 36*b*.

Each of the brush holders 46*a* and 46*b* is substantially in the form of a rectangular tube, and is fixed to the resin portion 43 by a mold fixing of the synthetic resin material charged into the window portion 44*b* of the core member 44. The power-feeding brushes 47*a* and 47*b* are retained and accommodated in the brush holders 46*a* and 46*b* such that the power-feeding brushes 47*a* and 47*b* can move in the frontward and rearward directions (inwardly and outwardly) relative the brush holders 46*a* and 46*b*. A base end portion of each of the power-feeding brushes 47*a* and 47*b* is pushed by a torsion coil spring 49*a*, 49*b* fixed to the core member 44 so that the power-feeding brushes 47*a* and 47*b* are biased toward the power-feeding plate 31. Accordingly, a tip portion of each of the power-feeding brushes 47*a* and 47*b* reaches the power-feeding plate 31 from one opening portion of the brush holder 46*a*, 46*b*, and can slide on the slip ring 36*a*, 36*b*.

A retaining hole for retaining the power-feeding brush 47*a*, 47*b* in this embodiment according to the present invention is given by a space existing inside the brush holder 46*a*, 46*b*. Because the brush holder 46*a*, 46*b* is made of a metal having a relatively high rigidity, a stable sliding movement of the power-feeding brush 47*a*, 47*b* is ensured. Moreover, because the brush holders 46*a* and 46*b* which are separated two members constitute two retaining holes for retaining the power-feeding brushes 47*a* and 47*b*, a reduction in size and weight is attained in addition to stable and proper sliding movement of each of the power-feeding brushes 47*a* and 47*b*. Moreover, the power-feeding brushes 47*a* and 47*b* are aligned neatly along the imaginary radial line of the cover member 12 whereas the slip rings 36*a* and 36*b* are disposed at radially inner and outer portions of the power-feeding plate 31 which correspond to the locations of the power-feeding brushes 47*a* and 47*b*. As viewed in the axial direction, two sides of the rectangular shape of the power-feeding brush 47*a*, 47*b* are perpendicular to a rotational direction of the slip ring 36*a*, 36*b*. By such a contact between the power-feeding brush 47*a*, 47*b* and the slip ring 36*a*, 36*b*, a stable power feeding to the electric motor 21 is secured.

The resin portion 43 is formed with a concave receiving portion 43*d* located at a substantially center portion of the resin portion 43. The concave receiving portion 43*d* axially passes through the insertion hole 44*a* of the core member 44, and is open to an inside surface (motor-side surface) of the resin portion 43. The concave receiving portion 43*d* receives or accommodates the detected portion 61 of the angular sensor 60. The resin portion 43 includes a bottom wall 43*e* which is a bottom portion of the concave receiving portion 43*d* and which is very thin. An after-mentioned control board 65 is attached and fixed to an outside surface (frontward surface) of the bottom wall 43*e* through a positioning convex portion 43*f* of the bottom wall 43*e*. The positioning convex portion 43*f* is formed to axially protrude from the bottom wall 43*e* in the frontward direction.

The cover portion 42 is substantially in the form of circular plate. The cover portion 42 includes an annular convex portion 42*a* which is formed in a standing manner at an outer circumferential edge portion of the cover portion 42. The annular convex portion 42*a* is fitted over an outer circumferential edge of an outside surface (of the resin portion 43) of the cover main body 41 by means of press fitting, so that the cover portion 42 is attached and fixed to the cover main body 41.

As shown in FIGS. 9 and 10, a pair of terminal strips 53*a* and 53*b* are buried in the cover main body 41. One end portion of each terminal strip 53*a*, 53*b* is introduced toward the brush holder 46*a*, 46*b* and connected with a pigtail harness 54*a*, 54*b* connected with a backend portion (the base end portion) of the power-feeding brush 47*a*, 47*b*. Another end portion of the terminal strip 53*a*, 53*b* is introduced to the power-feeding connector 43*b* and exposed to an external of the cover main body 41. The another end portion of the terminal strip 53*a*, 53*b* is connected with a connector (not shown) of the electronic control unit.

As shown in FIGS. 8 and 10, a plurality of terminal strips 55 are buried in the cover main body 41. One end portion of each terminal strip 55 is introduced to the control board 65 and connected with the control board 65. Another end portion of each terminal strip 55 is introduced to the communication connector 43*c* and exposed to the external of the cover main body 41. The another end portion of the terminal strip 55 is connected with a connector (not shown) of the electronic control unit.

Figure 11A:
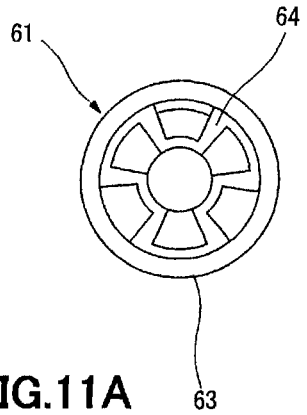
FIG. 11A is a front view of a detected portion shown in FIG. 2.
Figure 11B:
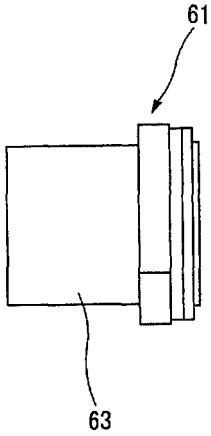
FIG. 11B is a side view of the detected portion.
Figure 12A:
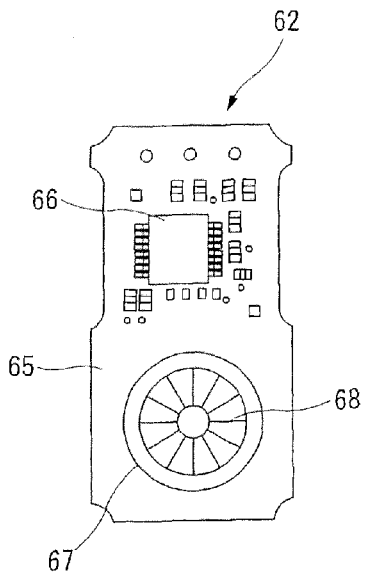
FIG. 12A is a plan view of a detecting portion shown in FIG. 2.
Figure 12B:
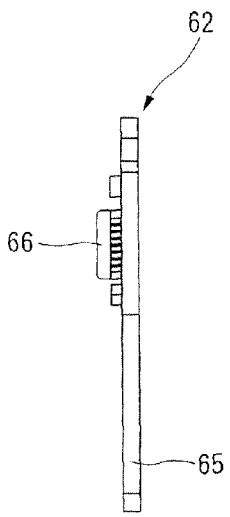
FIG. 12B is a side view of the detecting portion.
Figure 12C:
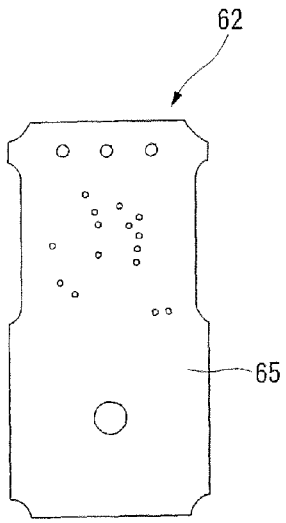
FIG. 12C is a bottom view of the detecting portion.

The angular sensor (angle sensing mechanism) 60 is provided between the receiving portion 43*d* of the cover main body 41 and the output shaft member 26. The angular sensor 60 functions to sense a rotational angular position of the output shaft member 26. The angular sensor 60 is a so-called electromagnetic induction type sensor. As shown in FIGS. 2, 11 and 12, the angular sensor 60 includes the detected portion 61 and a detecting portion 62. The detected portion 61 is fixed to the output shaft member 26 whereas the detecting portion 62 is fixed to a substantially central portion of the cover main body 41. The detecting portion 62 detects an electromotive force induced based on an inductive current (eddy current) generated in the detected portion 61. Because such an electromagnetic induction type sensor is adopted, the angle of the output shaft member 26 can be sensed with less influence of the electric motor 21. Hence, a favorable angle detection is attained.

As shown in FIG. 11, the detected portion 61 includes the tubular base portion 63 and the target 64. The tubular base portion 63 is made of a predetermined synthetic resin material and is substantially in the form of a cylinder having its bottom. The tubular base portion 63 is fitted in and fixed to an inner circumferential surface of a tip portion of the output shaft member 26 by press fitting. The target 64 is made of a predetermined electrically-conductive material and is a three-leaf-shaped thin metallic plate. The target 64 is fixed to a tip surface of the tubular base portion 63, i.e. fixed to an outside surface of a bottom wall of the tubular base portion 63.

As shown in FIG. 12, the detecting portion 62 includes the control board 65, an integrated circuit (ASIC) 66, an oscillation coil 67 and a detecting coil 68. The control board 65 is substantially in the form of rectangle, and is disposed to extend from the substantially central portion of the cover main body 41 in the radial direction of the cover main body 41. The integrated circuit 66 is mounted on an outer surface of longitudinally one end portion of the control board 65. The oscillation coil 67 is provided on an outer surface of longitudinally another end portion of the control board 65 such that the oscillation coil 67 is opposed to the target 64. The oscillation coil 67 is a primary coil that generates high-frequency magnetic field in the target 64. The detecting coil 68 is a secondary coil that detects an induced electromotive force based on an electromagnetic induction phenomenon of an inductive current (eddy current) generated in the target 64.

That is, a high-frequency magnetic field (i.e. magnetic flux from the oscillation coil 67 toward the target 64) which is generated by applying a high-frequency current to the oscillation coil 67 causes an eddy current (induced current) to flow in a metallic surface of the target 64. Magnetic flux generated in an opposite direction by an electromagnetic induction phenomenon of the eddy current of the target 64 causes an induced electromotive force in the detecting coil 68. As a result, this induced electromotive force varies based on a distance (gap) variation between the target 64 and the detecting coil 68 with the rotation of target 64. This variation of the induced electromotive force (i.e. inductance variation) is detected, and then, the integrated circuit 66 calculates an angle value corresponding thereto. This result is outputted to the electronic control unit.

As shown in FIGS. 2 and 3, the speed-reduction mechanism 22 includes the eccentric shaft portion 30, a fourth bearing B4, the plurality of rollers 20, and multiple internal teeth 13*c*. The eccentric shaft portion 30 is formed in the another end portion (cam-shaft-side portion) of the output shaft member 26 of the electric motor 21. (An outer circumferential surface of) the eccentric shaft portion 30 eccentrically rotates with the rotation of the output shaft member 26. The fourth bearing B4 is a known ball bearing having a relatively large diameter, and is fitted over the outer circumferential surface of the eccentric shaft portion 30 by press fitting. The plurality of rollers 20 are rotatably retained by the roller retaining portion 19 of the follower member 14, and roll on an outer circumferential surface of the fourth bearing B4 with the rotation of the eccentric shaft portion 30. The multiple internal teeth 13*c* are all-around formed in an inner circumferential portion (of the tubular base portion 13*a*) of the timing sprocket 13, and are configured to mesh with the plurality of rollers 20. The tubular base portion 13*a* of the timing sprocket 13 faces the plurality of rollers 20 in a radially inner direction of the follower member 14. Each of the multiple internal teeth 13*c* is substantially in the form of circular arc (arc-shaped groove) in cross section (as viewed in the axial direction).

A radial space (clearance) which has a radial width larger than or equal to a diameter of each roller 20 is formed in an annular shape between an outer circumferential surface of an outer race of the fourth bearing B4 and the multiple internal teeth 13*c*. By this radial space, whole of the fourth bearing B4 can move its rotational center with the eccentric rotation of the eccentric shaft portion 30. This rotational-center movement of the fourth bearing B4 moves the plurality of rollers 20 in the radial direction so that some of the plurality of rollers 20 are fitted in (meshed with) the internal teeth 13*c*. Accordingly, rotary drive force of the timing sprocket 13 is transmitted to the follower member 14.

More specifically, a meshing position between the plurality of rollers 20 and the internal teeth 13*c* is shifted by one (one tooth), per one rotation of the eccentric shaft portion 30. By this configuration, the rotation of the electric motor 21 is transmitted with speed reduction, so that the follower member 14 rotates relative to the timing sprocket 13 on the basis of the rotation of the electric motor 21.

Lubricating oil is supplied into the speed-reduction mechanism 22 by a lubricating-oil supplying means. As shown in FIG. 2, this lubricating-oil supplying means mainly includes an introduction passage 2*c* and an oil hole 18*a*. The introduction passage 2*c* is formed to extend in the axial direction inside the cam shaft 2. The introduction passage 2*c* introduces lubricating oil from a main oil gallery (not shown) through an internal oil passage of the cylinder head 1 to the oil hole 18*a*. The oil hole 18*a* is formed in the follower member 14 to pass through the follower member 14 in the axial direction. One end of the oil hole 18*a* is connected (i.e. continuous) with the introduction passage 2*c* whereas another end of the oil hole 18*a* is open to a bearing portion constituted by the second bearing B2 and the fourth bearing B4. The second bearing B2 and the fourth bearing B4 and the like which constitute the speed-reduction mechanism 22 are lubricated by the lubricating oil introduced from the main oil gallery.

Operations and effects of the valve-timing control apparatus in the first embodiment according to the present invention will now be explained referring to FIG. 2.

At first, when the engine is started, the valve-timing control apparatus 11 has already been set to a retard side to a maximum degree. At this time, the crankshaft is drivingly rotated by a starter motor (not shown), so that the timing sprocket 13 is rotated by the timing chain. Rotational force of the timing sprocket 13 synchronously rotates the electric motor 21 through the yoke 23 and the like. The rotational force of the timing sprocket 13 is also transmitted through the speed-reduction mechanism 22 constituted by the rollers 20 and the roller retaining portion 19 and the like, to the follower member 14 associated with the speed-reduction mechanism 22. Then, a cam(s) of the cam shaft 2 fixed to the follower member 14 rotates such that an intake valve (not shown) is opened and closed. By so doing, the intake valve is controlled not to cause a valve overlap, so that exhaust gas is inhibited from blowing back to an intake port. Accordingly, a startability is enhanced at the time of engine start or the like.

Next, in an engine operating state after the engine start, the electric motor 21 is drivingly rotated based on a control signal derived from the control unit, so that the rotational force of the electric motor 21 is transmitted through the speed-reduction mechanism 22 to the cam shaft 2. Hence, the cam shaft 2 rotates in a counter direction relative to the timing sprocket 13 such that a relative rotational phase between the cam shaft 2 and the timing sprocket 13 is varied. As a result, opening and closing timings (valve timings) of the intake valve are varied to take desired timings. Specifically, the valve-timing control apparatus 11 is controlled to change the opening and closing timings to an advance side, for example, with a rise of an operating load of the engine. As a result, the valve overlap is increased. Therefore, a combustion optimization according to the engine operating state, such as an enhance in torque, an improvement in to exhaust emission by virtue of increase of an internal EGR (exhaust gas recirculation), an improvement in fuel economy by virtue of reduction of a pumping loss, and the like are attained.

As mentioned above, in the valve-timing control apparatus 11, the power-feeding plate 31 rotates integrally with the timing sprocket 13 in one direction. As a result, lateral portions (i.e. outer circumferential surface) of each power-feeding brush 47*a*, 47*b* are in press-contact with (i.e. are pressed against) a tip edge of the brush holder 46*a*, 46*b* by being dragged by the rotation of the slip ring 36*a*, 36*b*. Because the power-feeding brush 47*a*, 47*b* slides on the brush holder 46*a*, 46*b* in this state, powder of the power-feeding brush 47*a*, 47*b* is produced due to abrasion. Such an abrasion powder falls in the vertically lower direction (gravitational-force direction) by gravity. However, in the case of the valve-timing control apparatus 11 according to this embodiment, each of the power-feeding brushes 47*a* and 47*b* exists radially outward of the target 64 of the angular sensor 60 and is located not to overlap with the target 64 in the vertically-upper direction (i.e., counter gravitational direction) from the target 64. Therefore, the abrasion power of the power-feeding brushes 47*a* and 47*b* which has fallen due to gravity is inhibited from adhering to the target 64.

As a more preferable example, in addition to the above condition, the power-feeding brushes 47*a* and 47*b* are arranged in the circumferential range Ad (see FIG. 7) of the cover member 12 over which the rotational direction R of the timing sprocket 13 has the vertically-lower component Rd, as viewed in the axial direction. Hence, the abrasion power which has dropped by gravity is not raised by the rotation of the timing sprocket 13 (or the power-feeding plate 31) as a plume of powder. Therefore, the abrasion power can be inhibited from adhering to the target 64, more effectively.

Second Embodiment

Figure 13:
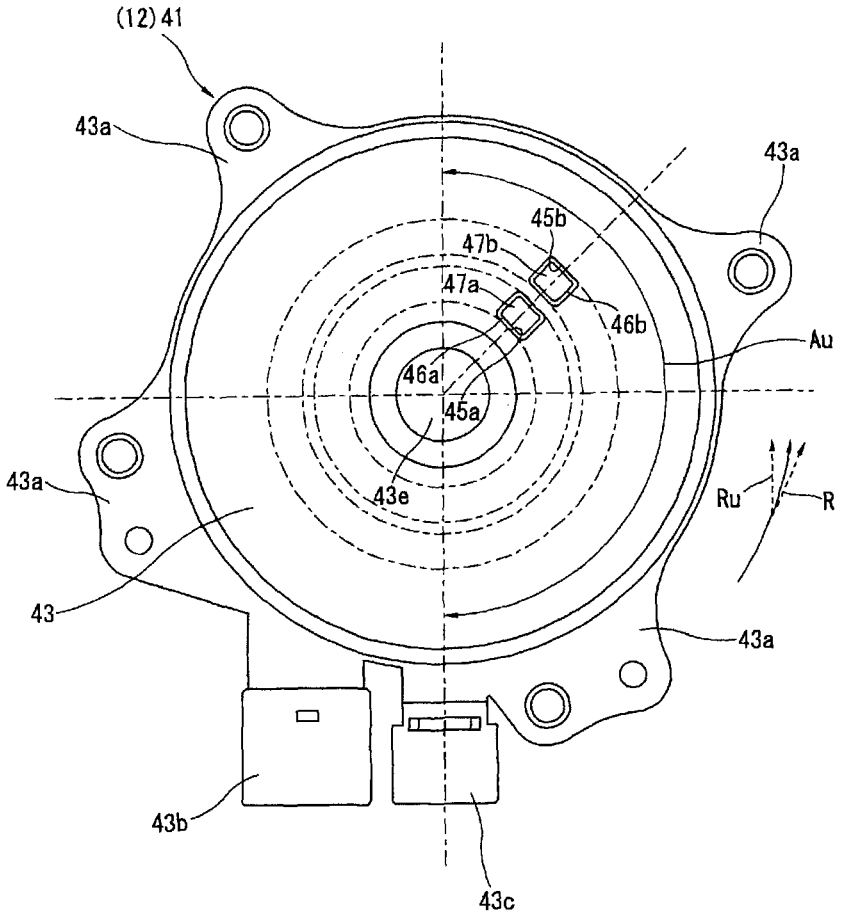
FIG. 13 is a view showing a valve-timing control apparatus in a second embodiment according to the present invention and corresponding to FIG. 7.

FIG. 13 shows a second embodiment of the valve-timing control apparatus for an internal combustion engine, according to the present invention. In the second embodiment, the arrangement of the power-feeding brushes 47*a* and 47*b* is changed from the first embodiment. The other configurations are the same as those of the first embodiment.

In the second embodiment, each of the power-feeding brushes 47*a* and 47*b* is located radially outward of the target 64 of the angular sensor 60 and located not to overlap with the target 64 in the vertically-upper direction from the target 64. In addition to this condition, the power-feeding brushes 47*a* and 47*b* are arranged in a circumferential range Au of the cover member 12 over which the rotational direction R of the timing sprocket 13 has a vertically-upper component Ru, as viewed in the axial direction. Moreover, the power-feeding brushes 47*a* and 47*b* are located above the target 64 with respect to the vertical direction (gravity direction). That is, an imaginary straight line connecting the center of the target 64 with the center of the power-feeding brush 47*a*, 47*b* is oblique (not perpendicular) to the vertical direction, as viewed in the axial direction.

Also in the second embodiment, the abrasion power of the power-feeding brushes 47*a* and 47*b* which has fallen by gravity is inhibited from adhering to the target 64 in the same manner as the first embodiment, because the power-feeding brushes 47*a* and 47*b* located above the target 64 of the angular sensor 60 do not overlap with the target 64 in the vertical direction.

Third Embodiment

Figure 14:
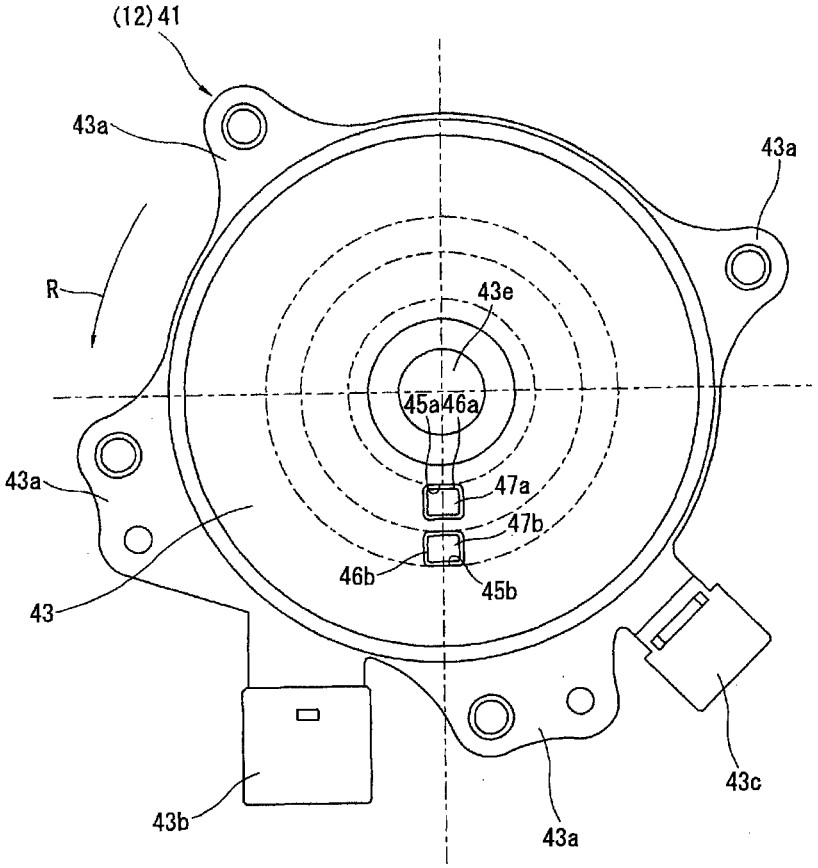
FIG. 14 is a view showing a valve-timing control apparatus in a third embodiment according to the present invention and corresponding to FIG. 7.

FIG. 14 shows a third embodiment of the valve-timing control apparatus for an internal combustion engine, according to the present invention. In the third embodiment, the arrangement of the power-feeding brushes 47*a* and 47*b* is changed from the first embodiment. The other configurations are the same as those of the first embodiment.

In the third embodiment, each of the power-feeding brushes 47*a* and 47*b* is located radially outward of the target 64 of the angular sensor 60 and located not to overlap with the target 64 in the vertically-upper direction from the target 64. In addition to this condition, the power-feeding brushes 47*a* and 47*b* are located under the target 64 with respect to the vertical direction (gravity direction). More specifically, the power-feeding brushes 47*a* and 47*b* are located directly underneath the target 64, and hence, overlap with the target 64 in a vertically-lower direction from the target 64. That is, an imaginary line connecting the center of the target 64 with the center of the power-feeding brush 47*a*, 47*b* is parallel to the vertical direction, as viewed in the axial direction. It is noted that, although the communication connector 43*c* is provided directly under the target 64 (to vertically overlap with the target 64) in the first embodiment, (an extension center line of) the communication connector 43*c* is located to be shifted (rotated) from that of the first embodiment in a counterclockwise direction of FIG. 14 for convenience of wirings caused by employing the structure of the third embodiment.

Also in the third embodiment, even if abrasion powder of the power-feeding brushes 47*a* and 47*b* falls by gravity, the abrasion power is prevented from adhering to the target 64 of the angular sensor 60 in the same manner as the first embodiment, because the power-feeding brushes 47*a* and 47*b* are located directly underneath the target 64 of the angular sensor 60.

Although the invention has been described above with reference to certain embodiments of the invention, the invention is not limited to the embodiments described above. Modifications and variations of the embodiments described above will occur to those skilled in the art in light of the above teachings.

For example, concrete configurations of members and parts which do not influence the effects of the above embodiments, such as the electric motor 21 and the speed-reduction mechanism 22 can be appropriately modified according to specifications of the apparatus and a vehicle in which the apparatus is mounted, or the like.

Moreover, according to the present invention, the angular sensor 60 is not limited to the electromagnetic induction type sensor as mentioned in the above embodiments. For example, the angular sensor 60 may be a sensor having the other structure (operating principle), such as a Hall-IC type angular sensor.

Next, some configurations obtainable from the above embodiments according to the present invention will now be listed.

[a] According to the above embodiments, the cover member (12) is integrally molded of a resin material, and the retaining hole (45*a*, 45*b*) is constituted by a retaining-hole constituting member (46*a*, 46*b*) buried in the cover member (12).

[b] According to the above embodiments, the slip ring (36*a*, 36*b*) is one of two flat-plate-shaped rings arranged concentrically, and the power-feeding brush (47*a*, 47*b*) is one of two brushes which are in contact with the two flat-plate-shaped rings.

[c] According to the above embodiments, the cover member (12) includes a power-feeding connector (43*b*) configured to supply electric power to the power-feeding brush (47*a*, 47*b*), and the power-feeding connector (43*b*) extends in a direction substantially perpendicular to an imaginary straight line connecting the two brushes with each other, as viewed in the axial direction.

This application is based on prior Japanese Patent Application No. 2014-211290 filed on Oct. 16, 2014. The entire contents of this Japanese Patent Application are hereby incorporated by reference.

The scope of the invention is defined with reference to the following claims.

What is claimed is:

1. A valve-timing control apparatus for an internal combustion engine, wherein an operating characteristic of an engine valve is varied by varying a relative rotational position between a first member and a second member, the valve-timing control apparatus comprising:

an electric motor configured to rotate the second member relative to the first member by rotating an output shaft of the electric motor;

a speed-reduction mechanism configured to reduce a rotational speed of the output shaft of the electric motor and to transmit a reduced rotation of the output shaft to the second member such that the second member is rotated relative to the first member;

a slip ring provided on a surface of a tip portion of the electric motor;

a cover member provided to cover at least a part of the surface of the tip portion of the electric motor;

a power-feeding brush disposed in the cover member such that the power-feeding brush is in contact with the slip ring; and an angle sensing mechanism configured to sense a rotational angle of the output shaft of the electric motor, wherein the angle sensing mechanism includes a detected portion attached to the output shaft of the electric motor, and a detecting portion attached to the cover member and opposed to the detected portion through a predetermined axial clearance, wherein the power-feeding brush is located so as not to overlap with the detected portion in a vertically-upper direction from the detected portion.

2. The valve-timing control apparatus according to claim 1, wherein the power-feeding brush is disposed slidably in a retaining hole formed in the cover member.

3. The valve-timing control apparatus according to claim 2, wherein the cover member is integrally molded of a resin material, and the retaining hole is constituted by a retaining-hole constituting member buried in the cover member.

4. The valve-timing control apparatus according to claim 1, wherein the power-feeding brush is located in a circumferential range of the cover member over which a rotational direction of the first member has a vertically-lower component.

5. The valve-timing control apparatus according to claim 4, wherein the power-feeding brush is located under the detected portion with respect to a vertical direction.

6. The valve-timing control apparatus according to claim 1, wherein the power-feeding brush is located in a circumferential range of the cover member over which a rotational direction of the first member has a vertically-upper component.

7. The valve-timing control apparatus according to claim 6, wherein the power-feeding brush is located above the detected portion with respect to a vertical direction, and located obliquely in the vertical direction from the detected portion.

8. The valve-timing control apparatus according to claim 1, wherein the power-feeding brush is located to overlap with the detected portion in a horizontal direction.

9. The valve-timing control apparatus according to claim 1, wherein the angle sensing mechanism is a non-contact electromagnetic-induction type sensor.

10. The valve-timing control apparatus according to claim 9, wherein the detected portion includes a non-circular exciting conductor, the detecting portion includes a primary coil, a secondary coil and a detecting circuit, and the detecting circuit is configured to detect an induced electromotive force of the secondary coil which is based on an inductive current of the exciting conductor generated by the primary coil, so that the rotational angle of the output shaft of the electric motor is detected.

11. The valve-timing control apparatus according to claim 1, wherein the slip ring is one of two flat-plate-shaped rings arranged concentrically, and the power-feeding brush is one of two brushes which are in contact with the two flat-plate-shaped rings.

12. The valve-timing control apparatus according to claim 11, wherein the cover member includes a power-feeding connector configured to supply electric power to the power-feeding brush, and the power-feeding connector extends in a direction substantially perpendicular to an imaginary straight line connecting the two brushes with each other.

13. A valve-timing control apparatus for an internal combustion engine, comprising:

a drive rotating member configured to rotate based on rotational force transmitted from a crankshaft;

a driven rotating member integrally formed with a cam shaft;

an electric motor integrally formed with the drive rotating member and configured to control a rotational phase of the driven rotating member relative to the drive rotating member by rotating an output shaft of the electric motor;

a slip ring provided on an axially end surface of the electric motor;

a cover member opposed to the slip ring;

a power-feeding brush provided slidably in a retaining hole formed in the cover member, the power-feeding brush being configured to supply electric power to the electric motor by a contact with the slip ring; and an angle sensing mechanism configured to sense a rotational angle of the output shaft of the electric motor through a detecting portion attached to the cover member, wherein the power-feeding brush is located at a portion of the cover member which prevents abrasion power of the power-feeding brush from adhering to the detecting portion even if the abrasion power falls by gravity.

14. The valve-timing control apparatus according to claim 13, wherein the angle sensing mechanism is a non-contact electromagnetic-induction type sensor.

15. The valve-timing control apparatus according to claim 14, wherein a non-circular exciting conductor is attached to the output shaft of the electric motor, the detecting portion includes a primary coil, a secondary coil and a detecting circuit, and the detecting circuit is configured to detect an induced electromotive force of the secondary coil which is based on an inductive current of the exciting conductor generated by the primary coil, so that the rotational angle of the output shaft of the electric motor is detected.

* * * * *